US006474079B2

(12) United States Patent
Odawara et al.

(10) Patent No.: US 6,474,079 B2
(45) Date of Patent: Nov. 5, 2002

(54) COOLING APPARATUS

(75) Inventors: Akikazu Odawara; Satoshi Nakayama; Atsushi Nagata, all of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/780,840

(22) Filed: Feb. 9, 2001

(65) Prior Publication Data

US 2001/0023592 A1 Sep. 27, 2001

(30) Foreign Application Priority Data

Feb. 16, 2000 (JP) ..... 2000-038435

(51) Int. Cl.[7] ..... F25B 19/00
(52) U.S. Cl. ..... 62/51.1; 62/50.1
(58) Field of Search ..... 62/51.1, 50.1

(56) References Cited

U.S. PATENT DOCUMENTS 4,872,314 A * 10/1989 Asano et al. ..... 62/50.1
4,909,038 A * 3/1990 Porter ..... 62/50.1
5,335,503 A * 8/1994 Lee ..... 62/50.1

* cited by examiner

*Primary Examiner*—Ronald Capossela
(74) *Attorney, Agent, or Firm*—Adams & Wilks

(57) ABSTRACT

A cooling apparatus has a liquid helium container for containing liquid helium, a vacuum chamber for providing heat insulation to external air, and a cooling head disposed in the vacuum chamber and capable of cooling down to a temperature region corresponding to the melting point of the liquid helium in the liquid helium container. An inlet port is disposed in the vacuum chamber for introducing thereinto the liquid helium stored in the liquid helium container. A vacuum heat insulation piping transfers liquid helium from the liquid helium container to the inlet port. A first piping is disposed in the vacuum chamber for transferring the liquid helium from the inlet port to the cooling head. A pump pumps liquid helium from the liquid helium container to the cooling head via the vacuum heat insulation piping, the inlet port and the first piping. A second piping transfers the liquid helium from the cooling head to the pump. At least part of the second piping is disposed in the vacuum chamber.

20 Claims, 8 Drawing Sheets

COOLING APPARATUS

BACKGROUND OF THE INVENTION

1. Field of the Invention

This invention relates to apparatus for measuring, observing, or carrying out operations on work pieces composed of various elements and materials such as various semiconductor elements and semiconductor materials, superconducting materials, or other metallic or organic materials, etc., at temperatures as low as a boiling point of liquified gas, while cooling the work piece so as to keep the work piece at a low temperature. 2. Description of the Prior Art Recently, high sensitivity fluxmeters referred to as SQUID (superconducting quantum interferometer) microscopes having a spatial resolution in the order of micrometers have been implemented, with measurements of various elements and materials using a Squid microscope becoming commonplace. SQUIDs use superconductors, and therefore have to be cooled to a low temperature (from a few K to 77K) lower than the temperature of liquid nitrogen. It is also often necessary to keep aworkpiece at a low temperature. In addition to SQUID, there are also cases where a work piece is maintained at a low temperature during observation by a tunnel microscope or an atomic force microscope.

FIG. 2 is a schematic view showing an example of a related cooling apparatus for cooling a sensor side to a low temperature. A tri-axial scanning stage 20, cooling head 30, storage tank 40, sensor 50, and work piece 60 etc. are located within a vacuum chamber 10, and a vacuum pump 70, liquid helium container 80, and vacuum insulation piping 90 are located outside of the vacuum chamber 10.

The vacuum chamber 10 is made of stainless steel, with a vacuum being maintained therein in order to provide thermal insulation with the outside.

The tri-axial scanning stage 20 is installed with the work piece 60, and is used to control the relative positions of the sensor 50 and the work piece 60.

The cooling head 30 is made of pure copper and maintains a state of thermal contact with the sensor 50.

The storage tank 40 holds a refrigerant for cooling the cooling head 30. In order to use liquid helium as a coolant, a connection is made with the liquid helium container 80 using the vacuum insulation piping 90 and transferring is carried out in order to save liquid helium in the storage tank 40. In order to reduce infiltrating heat, a heat insulating coolant tank 41 is located around the storage tank 40 and holds liquid nitrogen.

A SQUID having a detection coil with a diameter in the order of 10 mm is employed as the sensor 50. Niobium operating at the melting point of liquid helium is employed as the superconducting material from which the SQUID is made.

By actuating the vacuum pump 70, coolant stored in the storage tank 40 is conveyed through piping 31 to the cooling head 30. After the cooling head 30 is cooled, the coolant is discharged from piping 32 to the outside through the vacuum pump 70.

In a procedure for measuring distribution of the magnetic field of the work piece 60, liquid nitrogen is saved to the storage tank 40 and the heat insulating coolant tank 41, and the periphery of the storage tank 40 is cooled down to the melting temperature of liquid nitrogen. Liquid nitrogen that has entered the storage tank 40 is then removed, the storage tank 40 and the liquid helium container 80 are connected by vacuum insulation piping 90, and liquid helium constituting the coolant is transferred to the storage tank 40. After this, the vacuum pump 70 is actuated, liquid helium flows through to the cooling head 30, and the cooling head 30 is cooled down to in the region of the melting temperature of helium. The sensor 50 is then actuated, the relative positions of the sensor 50 and the work piece 60 are controlled using the tri-axial scanning stage 20, and the measuring can be carried out by recording a signal from the sensor 50.

With the related cooling apparatus where it is necessary to cool the sensor or work piece to a low temperature, it is necessary to transfer liquid helium to a storage tank equipped with a vacuum chamber and keep it there. It is also necessary to remove liquefied gas directly prior to the transfer of liquid helium after introducing liquefied gas such as liquid nitrogen to the storage tank once prior to transfer and pre-cooling the storage tank down to the melting temperature of liquefied gas. It is also necessary to fill up the heat insulating coolant tank 41 located around the periphery of the storage tank with liquefied gas such as liquid nitrogen. Cooling of the sensor or work piece down to a low temperature is therefore both troublesome and time consuming, and it is also necessary to prepare a coolant such as liquid nitrogen, etc. Further, because it is necessary to temporarily hold liquid helium in the storage tank, particularly in cases where the time taken to cool the sensor or work piece down to a low temperature is short, the amount of liquid helium consumed in order to cool the storage tank in comparison to the amount of liquid helium consumed in order to cool the cooling head cannot be ignored, and the loss of liquid helium is substantial as a result. Moreover, the vacuum chamber is large because a liquid helium storage tank is provided at the vacuum chamber, which also makes the footprint of the cooling apparatus substantial.

SUMMARY OF THE INVENTION

Rather than providing a storage tank for liquid helium within the vacuum chamber, a liquid helium introduction port is provided taking into consideration heat insulation. A liquid helium container and the port are then connected by vacuum heat insulating piping so that liquid helium is supplied directly from the container.

DETAILED DESCRIPTION OF THE PREFERRED EMBODIMENT

In the following, the principal of the present invention will be described.

First Means

In order to resolve the aforementioned problems, in the present invention, rather than providing a storage tank for liquid helium within the vacuum chamber, a liquid helium introduction port is provided, taking into consideration heat insulation. A liquid helium container and the port are then connected by vacuum heat insulating piping so that a liquid helium coolant is supplied directly from the container.

Second Means

In addition to the first means, the vacuum heat insulating piping is two-tier vacuum piping.

Third Means

In addition to the first means, a heat-shielding plate is located at the periphery of the port.

Fourth Means

In addition to the third means, helium exhausted from the cooling head is allowed to pass within the heat-shielding plate.

Fifth Means

In addition to the third means, the port introducing the liquid helium is composed of a plurality of materials.

According to a structure for a cooling apparatus using the first means, it is no longer necessary to transfer liquid helium to and hold liquid helium in a storage tank with a large thermal capacity, nor is it any longer necessary to pre-cool a vacuum chamber using coolant such as liquid nitrogen etc. because helium is supplied from a liquid helium container to the cooling head directly through heat-shielding piping. This means that this process is no longer troublesome, nor time-consuming.

With the second means, the amount of liquid helium consumed can be kept low because very little heat permeates through the vacuum heat-shielding piping between the vacuum chamber and the container.

With the third means, the heat insulating coolant tank provided about the port is no longer necessary, it is no longer necessary to prepare coolant such as liquid nitrogen etc. to carry out heat insulation, the vacuum chamber can be made small, and the footprint can also be made small as a result.

With the fourth means, the ability to cool the heat-shielding plate is improved, the permeation of heat to the port and the first piping is reduced, and the liquid helium can be utilized effectively.

With the fourth means, the ability to cool the heat-shielding plate is improved, the permeation of heat to the port and the first piping is reduced, and the liquid helium can be utilized effectively.

The sensor of this invention is not just a sensor for measuring magnetic flux and various radiation emitted from a work piece and measuring physical properties and characteristics of a work piece, but also includes probes etc. for tunnel microscopes and atomic force microscopes, and probes for scanning the shape and state of the surfaces of work pieces.

The following is a description, with reference to the drawings, of the preferred embodiments of the present invention.

First Embodiment

Figure 1:
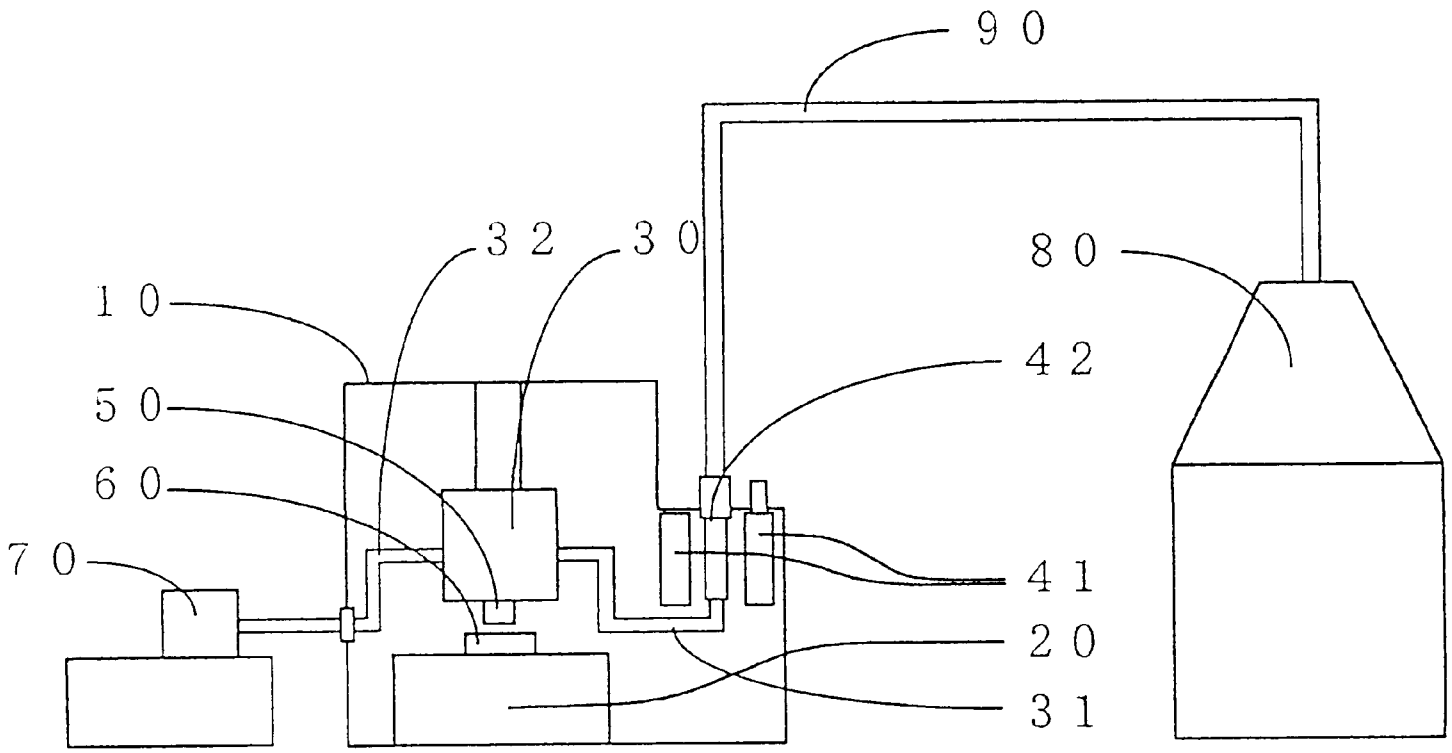
FIG. 1 is a schematic view showing a structure for a cooling apparatus representing the first embodiment of the present invention.
Figure 2:
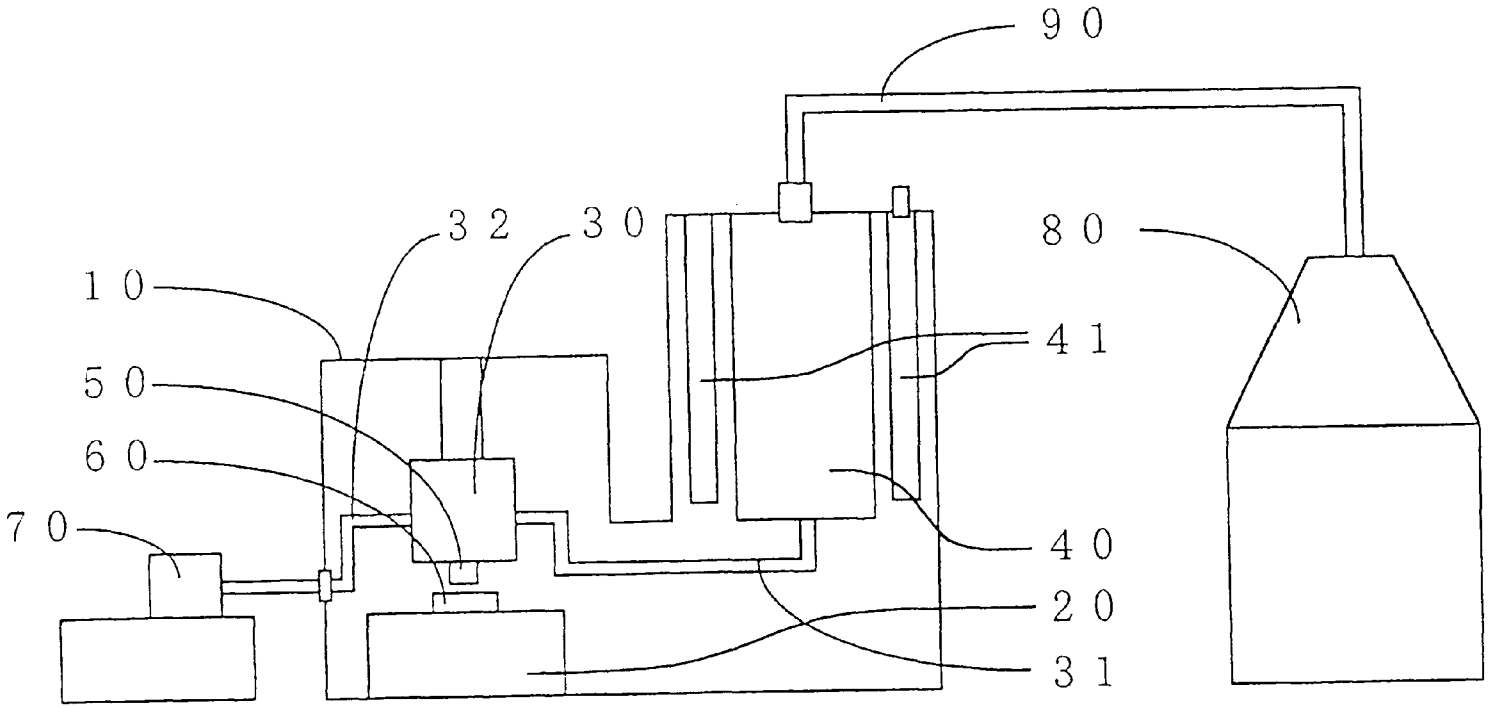
FIG. 2 PRIOR ART
FIG. 2 is a schematic view showing a structure for a related cooling apparatus.

FIG. 1 is a schematic view showing a structure for a cooling apparatus representing a first embodiment of the present invention.

A tri-axial scanning stage 20, cooling head 30, a liquid helium introduction port 42, sensor 50, and work piece 60 etc. are located within a vacuum chamber 10, and a vacuum pump 70, liquid helium container 80, and vacuum insulation piping 90 are located outside of the vacuum chamber 10.

The vacuum chamber 10 is made of stainless steel, with a vacuum being maintained in order to provide thermal insulation with the outside.

The tri-axial scanning stage 20 is installed with the work piece 60, and is used to control the relative positions of the sensor 50 and the work piece 60.

The cooling head 30 is made of pure copper in order to improve thermal conduction and maintains a state of thermal contact with the sensor 50.

The port 42 is for introducing liquid helium to the cooling head 30 located within the vacuum chamber. The port 42 and the liquid helium container 80 are connected by the vacuum insulation piping 90, the liquid helium held in the liquid helium container 80 is introduced to the cooling head 30. In order to reduce infiltrating heat around the periphery of the port 42, a heat insulating coolant tank 41 is located around the port 42 in a shape that encompasses the port 42, and holds liquid nitrogen.

A SQUID having a detection coil with a diameter in the order of 10 mm is employed as the sensor 50. Niobium operating at the melting point of liquid helium is employed as the superconducting material from which the SQUID is made.

The vacuum pump 70 lowers the pressure within the second piping 32, cooling head 30, first piping 31 and the vacuum insulation piping 90, and is used to transfer liquid helium to within the liquid helium container 80.

In a procedure for measuring distribution of the magnetic field of the work piece 60, liquid nitrogen is saved to the heat insulating coolant tank 41, and the periphery of the port 42 is cooled down to the melting temperature of liquid nitrogen. Next, the port 42 and the liquid helium container 80 are connected by the vacuum insulation piping 90. Therefore, by actuating the vacuum pump 70, the cooling head 30 is cooled down to in the region of the melting point of helium as a result of liquid helium within the liquid helium container 80 passing through to the cooling head 30. After cooling the cooling head 30, the sensor 50 is actuated, the relative positions of the sensor 50 and the work piece 60 are controlled using the tri-axial scanning stage 20, and measurements are carried out by recording a signal from the sensor 50.

Second Embodiment

Figure 3:
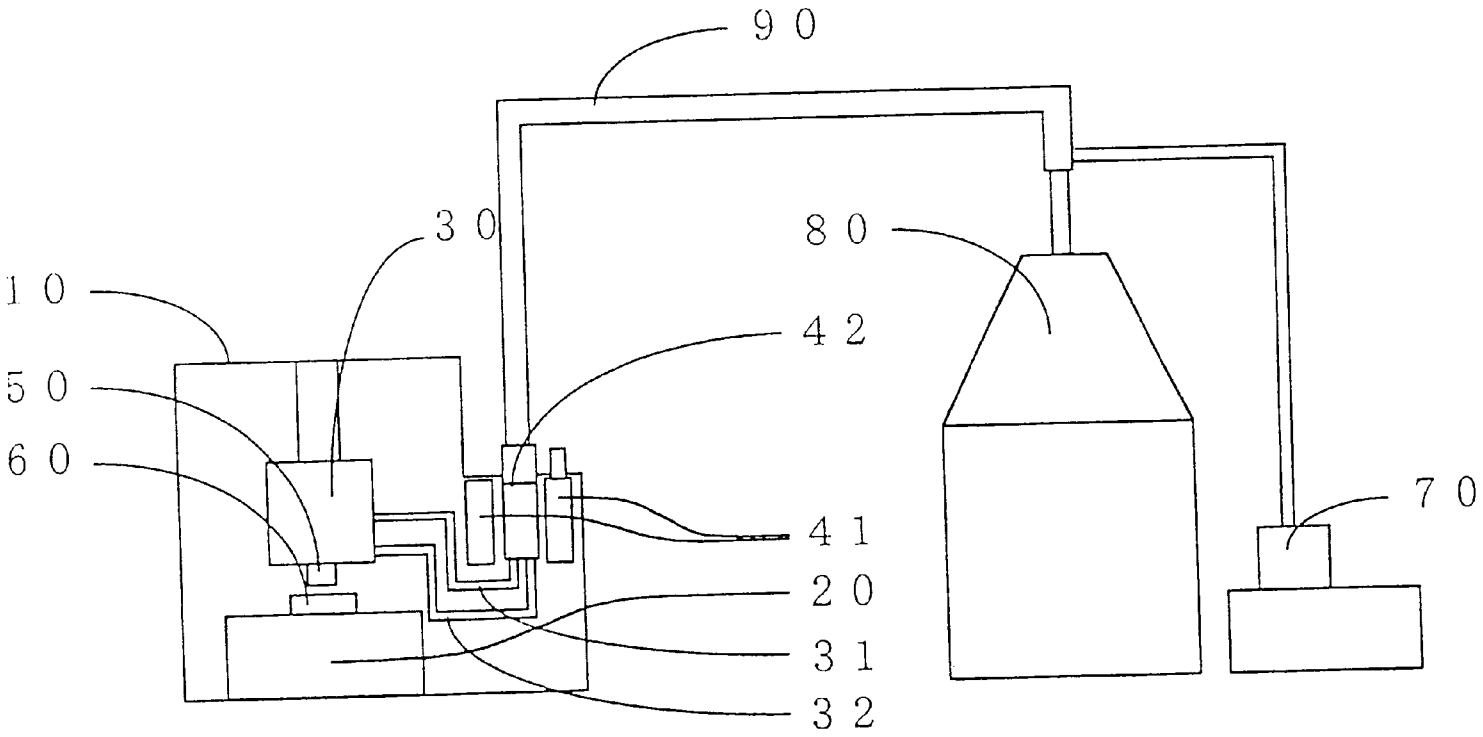
FIG. 3 is a schematic view showing a structure for a cooling apparatus representing the second embodiment of the present invention.

FIG. 3 is a schematic view showing a structure for a cooling apparatus exhibiting a second embodiment of the present invention. Other than the vacuum insulation piping 90 being two tier vacuum piping, the structure is no different to that of the first embodiment.

Figure 4A:
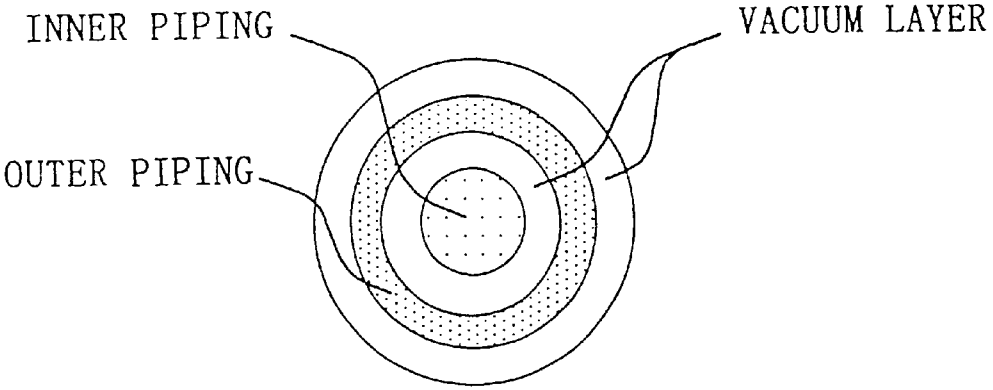
FIG. 4A is a view showing a structure for a cross-section of the vacuum insulation piping 90 of a second embodiment of the present invention.
Figure 4B:
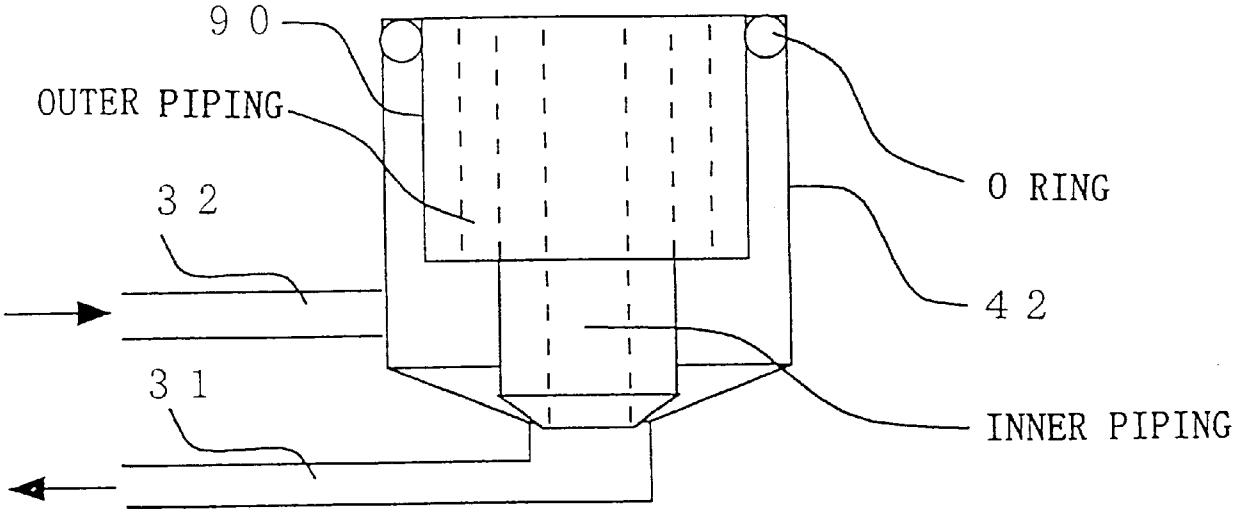
FIG. 4B is a view showing a structure for the end of a port 42 and vacuum insulation piping 90 of the second embodiment of the present invention.

FIG. 4A is a view showing a cross-section of a structure for the vacuum insulation piping 90 of the second embodiment of the present invention, and FIG. 4B is a view showing the structure of the end of the port 42 and the vacuum insulation piping 90. Inner piping of the two tier vacuum piping is a path for passing helium through to the cooling head, and outer piping is a path for passing helium exhausted from the cooling head.

The pressure of the outer piping of the vacuum insulation piping 90, the second piping 32, the cooling head 30, the first piping 31 and the inner piping of the vacuum insulation piping 90 is lowered by actuating the vacuum pump 90 connected to the outer piping of the vacuum insulation piping 90, the liquid helium within the liquid helium container 80 is transferred. As a path for the helium, the helium is transferred from the liquid helium container 80 to the cooling head 30 via the inner piping of the vacuum insulation piping 90 and the first piping 31. After the cooling head 30 is cooled, the helium passes through the outer piping of the vacuum insulation piping 90 from the second piping 32, and is discharged from the vacuum pump 90.

Third Embodiment

Figure 5:
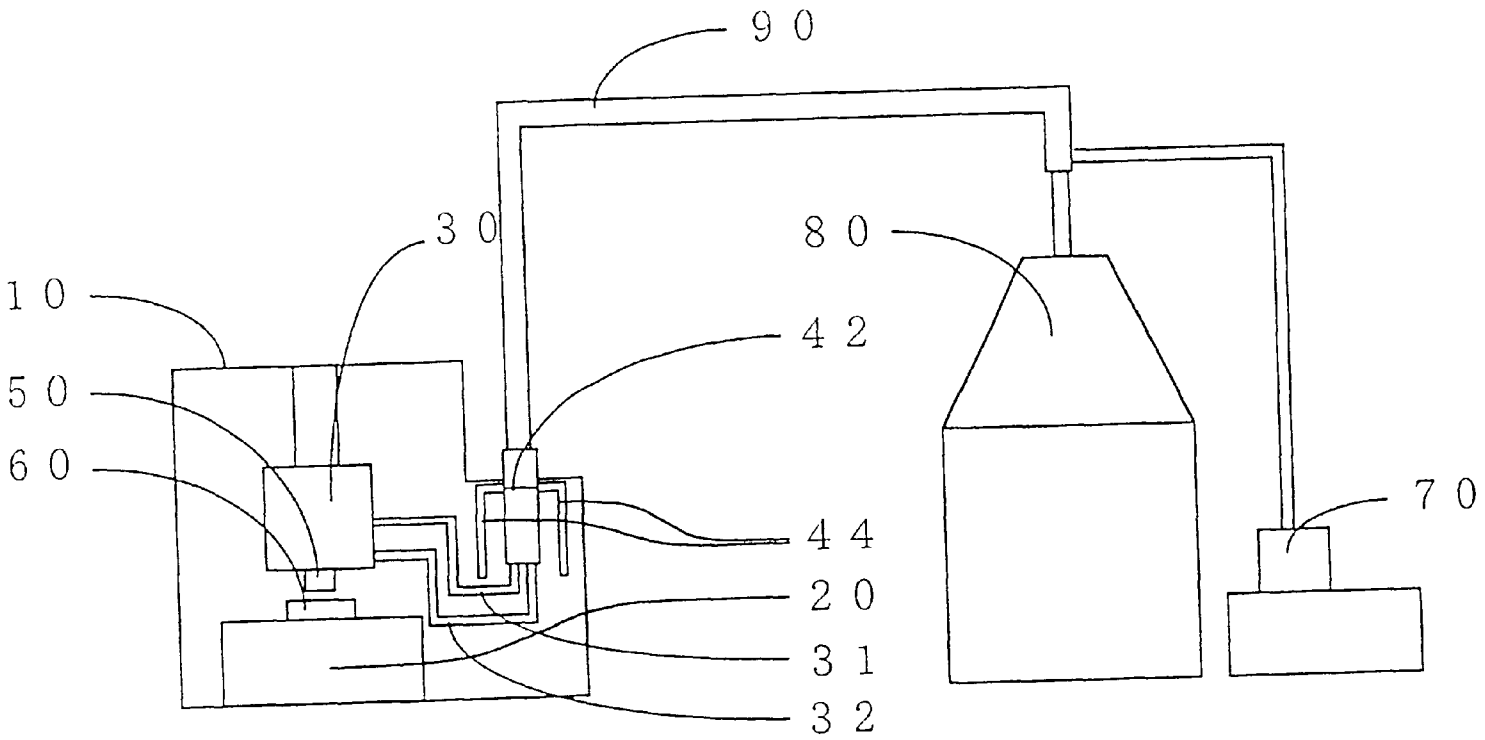
FIG. 5 is a schematic view showing a structure for a cooling apparatus representing the third embodiment of the present invention.

FIG. 5 is a schematic view showing a structure for a cooling apparatus representing a third embodiment of the present invention. Other than the heat insulating coolant tank 41 replaced by a heat-shielding plate, the structure is no different to that of the second embodiment.

Figure 6:
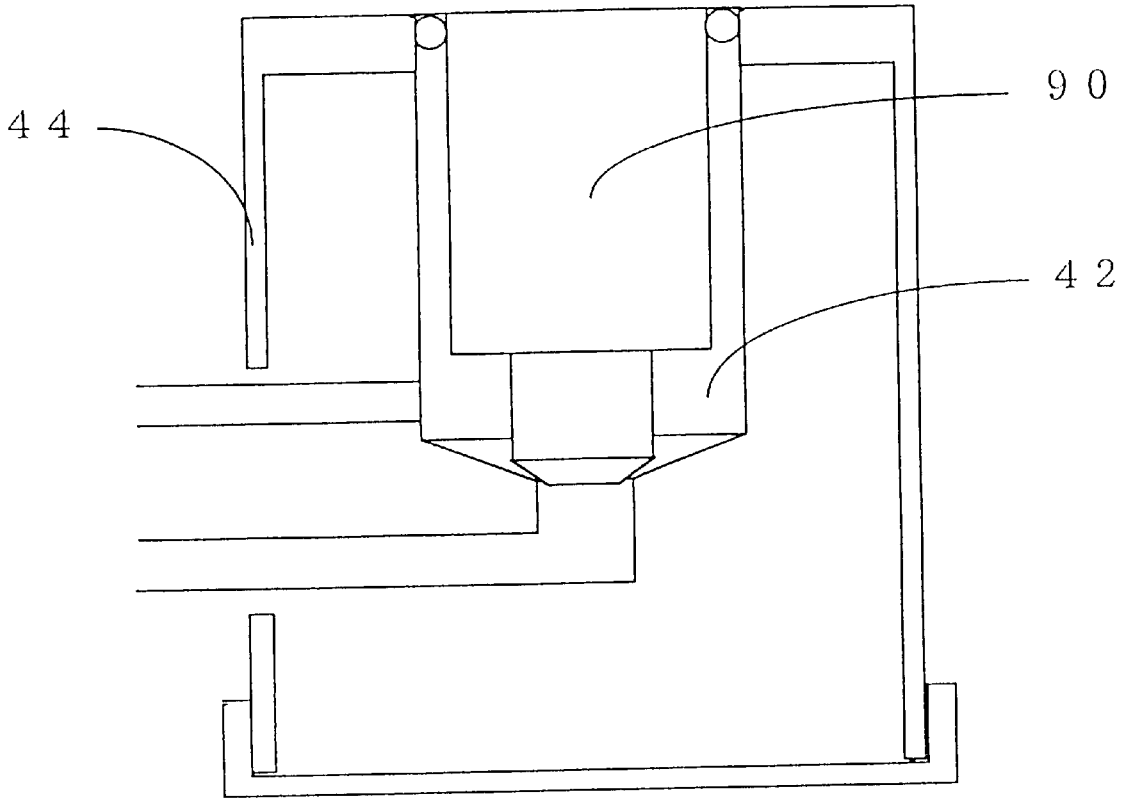
FIG. 6 is a view showing the structure of the periphery of the heat-shielding plate 44 of the third embodiment of the present invention.

FIG. 6 shows the structure of the heat-shielding plate 44. The heat-shielding plate 44 is a veneer processed so as to be molded into a cylindrical shape, and is thermally connected to the outer wall of the port 42 cooled down to below the region of the temperature of the melting point of liquid nitrogen. When the port 42 is covered by the heat-shielding plate 44, a hole, communicating with the first and second piping 31 and 32, is made in part of the side surface. The heat-shielding plate 44 is made of pure copper in order to improve thermal conduction.

Fourth Embodiment

Figure 7:
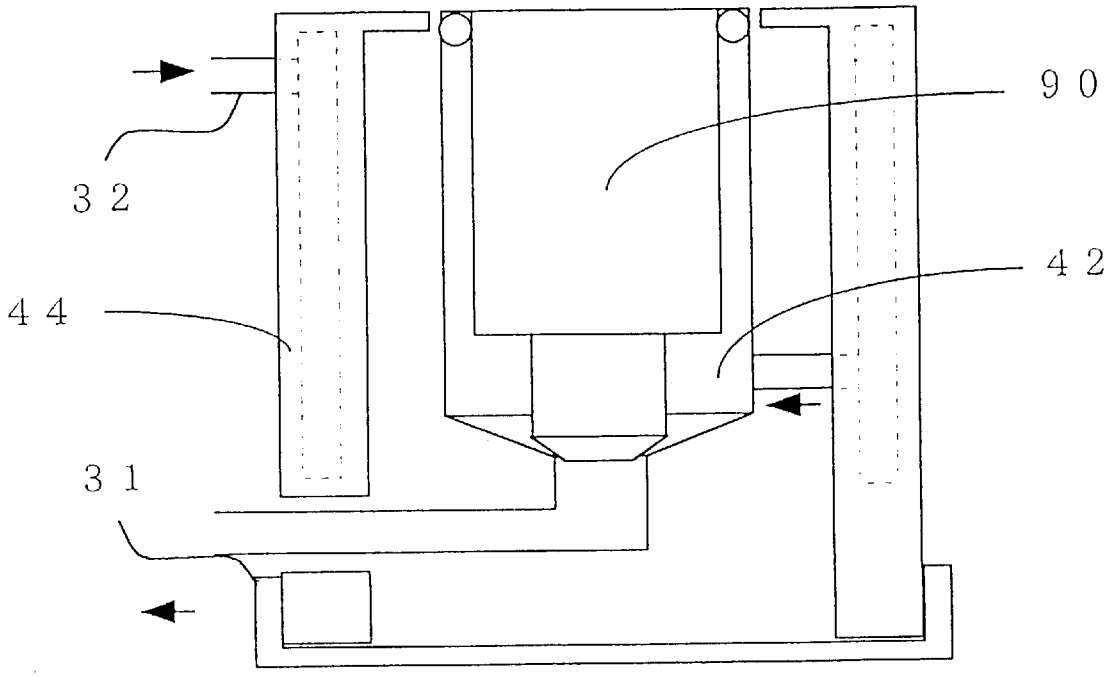
FIG. 7 is a schematic view showing a structure for the periphery of the heat-shielding plate 44 of the cooling apparatus representing the fourth embodiment of the present invention.

FIG. 7 is a schematic view showing a structure for the perimeter of the heat-shielding plate 44 of a cooling apparatus representing a second embodiment of the present invention. Other than the structure of the heat-shielding plate 44 and a method of connecting the second piping 32 and the port 42, the structure is no different to that of the third embodiment.

With the heat-shielding plate 44, the second piping 32 and the port 42 are connected using two-tier piping having a sealed space therebetween, as shown by the broken line in FIG. 7. A structure is adopted for passing helium for after the cooling head 30 is cooled at the space within the heat-shielding plate 44. This internal space is taken to be a cavity, but this can also be filled with a mesh or granules of pure copper, or other material as a heat exchanging material. The heat-shielding plate 44 is made of pure copper in order to improve thermal conduction.

Fifth Embodiment

Figure 8:
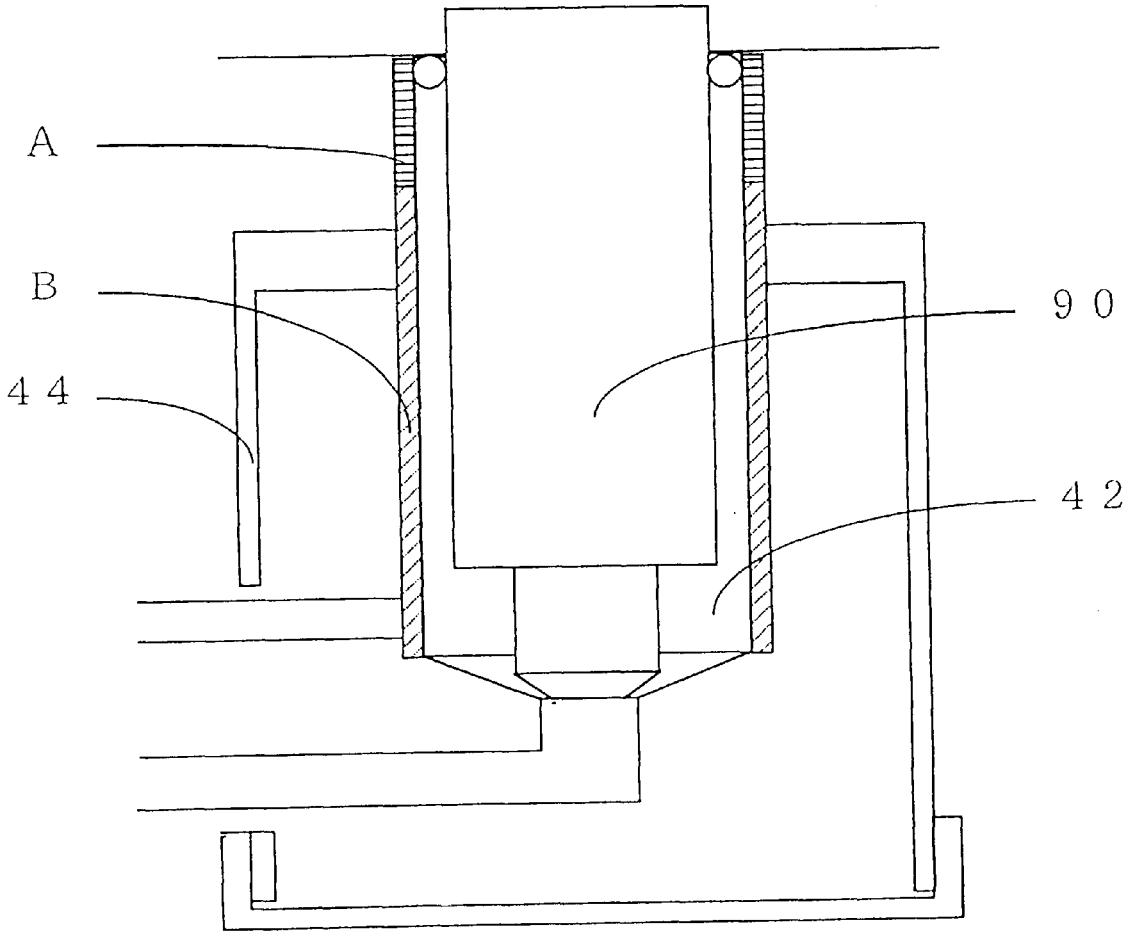
FIG. 8 is a schematic view showing the perimeter of the port 42 of the cooling apparatus exhibiting the fifth embodiment of the present invention.

FIG. 8 is a schematic view showing a structure for the perimeter of the port 42 of a cooling apparatus exhibiting a fifth embodiment of the present invention. Aspects other than the material for the port 42 are the same as for the third embodiment. Here, a structure is adopted for the port 42 where a portion A making direct contact with the outside wall of the vacuum chamber 10 is made of a material of a low thermal conductivity and a portion B is made of a material of a high thermal conductivity. Specifically, G-FRP is employed as a material of a low thermal conductivity and pure copper is employed as a material of a high thermal conductivity.

According to the present invention, it is no longer necessary to cool a storage tank in advance using liquid gas such as liquid nitrogen prior to transferring helium because the storage tank for liquid helium does not have to be installed within the vacuum chamber, and it is therefore not necessary to remove the liquid gas. This reduces both the work involved and the time taken to cool a sensor or work piece down to a low temperature.

What is claimed is:

1. A cooling apparatus comprising:

a liquid helium container for containing liquid helium;

a vacuum chamber for providing heat insulation to external air;

a cooling head disposed in the vacuum chamber and capable of cooling down to a temperature region corresponding to the melting point of the liquid helium in the liquid helium container;

an inlet port disposed in the vacuum chamber for introducing thereinto the liquid helium stored in the liquid helium container;

vacuum heat insulation piping for transferring liquid helium from the liquid helium container to the inlet port;

a first piping disposed in the vacuum chamber for transferring the liquid helium from the inlet port to the cooling head;

a pump for pumping liquid helium from the liquid helium container to the cooling head via the vacuum heat insulation piping, the inlet port and the first piping; and a second piping for transferring the liquid helium from the cooling head to the pump, at least part of the second piping being disposed in the vacuum chamber.

2. A cooling apparatus according to claim 1; wherein the vacuum heat insulation piping comprises a coaxial two-tier vacuum piping.

3. A cooling apparatus according to claim 1; further comprising a heat-shielding plate disposed around a periphery of the inlet port.

4. A cooling apparatus according to claim 3; wherein the heat-shielding plate comprises a vacuum sealed container connected to the vacuum heat insulating piping so that liquid helium from the liquid helium container is transferred to the vacuum sealed container and is introduced into the inlet port.

5. A cooling apparatus according to claim 3; wherein the inlet port comprises a tubular member made of a plurality of materials each having a different thermal conductivity.

6. A cooling apparatus according to claim 5; wherein the tubular member has a first portion having a first thermal conductivity and disposed in direct contact with the vacuum chamber and a second portion having a second thermal conductivity greater than the first thermal conductivity.

7. A cooling apparatus according to claim 1; wherein the liquid helium container is not disposed in the vacuum chamber.

8. A cooling apparatus according to claim 1; wherein the pump is not disposed in the vacuum chamber.

9. A cooling apparatus according to claim 1; further comprising a cooling tank surrounding the inlet port for cooling the inlet port.

10. A cooling apparatus according to claim 9; wherein the cooling tank contains nitrogen.

11. A cooling apparatus comprising:

a container for storing a refrigerant;

a vacuum chamber containing a cooling head capable of cooling down to a temperature region corresponding to the melting point of the refrigerant stored in the container;

an inlet port disposed in the vacuum chamber for introducing thereinto the refrigerant stored in the container;.

a vacuum heat insulation piping for transferring refrigerant from the container to the inlet port;

first transfer means disposed in the vacuum chamber for transferring the refrigerant from the inlet port to the cooling head;

a pump for pumping the refrigerant stored in the container to the cooling head via the vacuum heat insulating piping, the inlet port and the first transfer means; and second transfer means for transferring the refrigerant from the cooling head to the pump, at least part of the second transfer means being disposed in the vacuum chamber.

12. A cooling apparatus according to claim 11; wherein the inlet port, the first transfer means and at least part of the second transfer means are disposed in the vacuum chamber.

13. A cooling apparatus according to claim 11; wherein the vacuum heat insulation piping comprises a coaxial two-tier vacuum piping.

14. A cooling apparatus according to claim 11; further comprising a heat-shielding plate disposed around a periphery of the inlet port.

15. A cooling apparatus according to claim 14; wherein the heat-shielding plate comprises a vacuum sealed container connected to the vacuum heat insulating piping so that refrigerant from container is transferred to the vacuum sealed container and is introduced into the inlet port.

16. A cooling apparatus according to claim 11; wherein the inlet port comprises a tubular member made of a plurality of materials each having a different thermal conductivity.

17. A cooling apparatus according to claim 16; wherein the tubular member has a first portion having a first thermal conductivity and disposed in direct contact with the vacuum chamber and a second portion having a second thermal conductivity greater than the first thermal conductivity.

18. A cooling apparatus according to claim 11; wherein the container is not disposed in the vacuum chamber.

19. A cooling apparatus according to claim 11; further comprising a cooling tank surrounding the inlet port for cooling the inlet port.

20. A cooling apparatus according to claim 19; wherein the cooling tank contains nitrogen.

* * * * *